United States Patent [19]

Rodo

[11] Patent Number: 4,663,947

[45] Date of Patent: May 12, 1987

[54] MECHANISM TO PRODUCE IRREGULAR EFFECTS IN WARP KNITTING

[76] Inventor: Ramon A. Rodo, Calle del Forn Nr. 42, Terrassa (Barcelona), Spain

[21] Appl. No.: 822,706

[22] Filed: Jan. 24, 1986

[30] Foreign Application Priority Data

Jan. 30, 1985 [ES] Spain ..... 539953

[51] Int. Cl.[4] ..... D04B 27/12

[52] U.S. Cl. ..... 66/213

[58] Field of Search ..... 66/213

[56] References Cited

U.S. PATENT DOCUMENTS 3,036,448 5/1962 Cundiff ..... 66/213
3,063,272 11/1962 Bolton ..... 66/213
3,096,559 7/1963 McNamara ..... 66/213
4,197,725 4/1980 Kohl ..... 66/213
4,235,083 11/1980 Dale et al. ..... 66/213

FOREIGN PATENT DOCUMENTS 2327344 6/1977 France ..... 66/213

*Primary Examiner*—Ronald Feldbaum
*Attorney, Agent, or Firm*—Flynn, Thiel, Boutell & Tanis

[57] ABSTRACT

A mechanism to produce irregular effects in warp knitting on a conventional machine having a rotary camshaft which controls movement of a fork engaged with the yarn. A mechanical device selectively and independently controls translatory movement of the camshaft in two transverse directions to respectively vary the depth and intermittency of the yarn tension.

3 Claims, 2 Drawing Figures

MECHANISM TO PRODUCE IRREGULAR EFFECTS IN WARP KNITTING

The present patent relates to improvements to mechanisms intended for producing irregular effects, having varying appearances, in warp-knitted fabrics manufactured on Keite and Raschel machines.

In accordance with the improvements mentioned, very important advantages have been achieved on fine-gauge machines on which it is impossible to use sufficiently irregular yarns to produce the effects aimed at, owing to the fact that it would be very difficult and costly to manufacture them and due to the difficulties that the fineness of the knitting members would cause in the processing of such yarns.

The improvements in question have led to appearances not hitherto achieved, such as slub yarns, roughnesses, coarseness, moire and crepe effects, etc., all this being achieved using warp-knitting machines which are conventional in respect of their knitting elements, and with natural, artificial and synthetic spun yarns, plain or textured, both in gray form for piece dyeing and with arrangements of colors or materials for the production of creative patterns.

The invention is based on taking advantage of the deformation which takes place in the fabric when some needles are fed differently with respect to others, in a predetermined order at the moment of producing the stitch, and while the warp beams are supplying the yarn uniformly and at constant speed.

The principle referred to has already been used years ago with a jacquard mechanism for the production of more or less symmetrical patterns. But, although starting from the same principle, the mechanisms constructed in accordance with the improvements forming the subject of the present invention offer completely novel features in respect of system, in respect of range of patterns, which is virtually unlimited, and as regards the reliability and speed with which the patterns can be obtained and varied.

The principal advantages provided by the improvements forming the subject of the present patent, with respect to known embodiments, are as follows:

(a) unlimited range of new design possibilities, from millimetric crepe-look effects to broad slubbed effects, passing through all the intermediate stages, with the possibility of continuously increasing and decreasing the feed of yarn, or with intermittent effects and combinations which cannot be achieved with other mechanisms, and also patterns of geometrical shapes.

(b) possibility of achieving all the above independently of the pattern obtained by the displacement of the reeds moved by the pattern chain.

(c) possibility of using, without distinction, continuous textured or plain, natural, artificial or synthetic yarns.

(d) possibility of easily changing the pattern obtained by means of the irregular effect in the fabric, including making such a change without stopping or slowing the operation of the loom, which possibility has hitherto been unknown.

(e) reduction in the time required for threading the yarns, with respect to previous systems, thus optimizing the increase in added value which is very substantially greater than the increase in production costs.

With a view to providing a more detailed explanation and making it easier to understand, various drawings are attached illustrating a practical embodiment in accordance with the improvements of the invention, which embodiment is given merely by way of example, not limiting the scope of the said invention.

Figure 1:
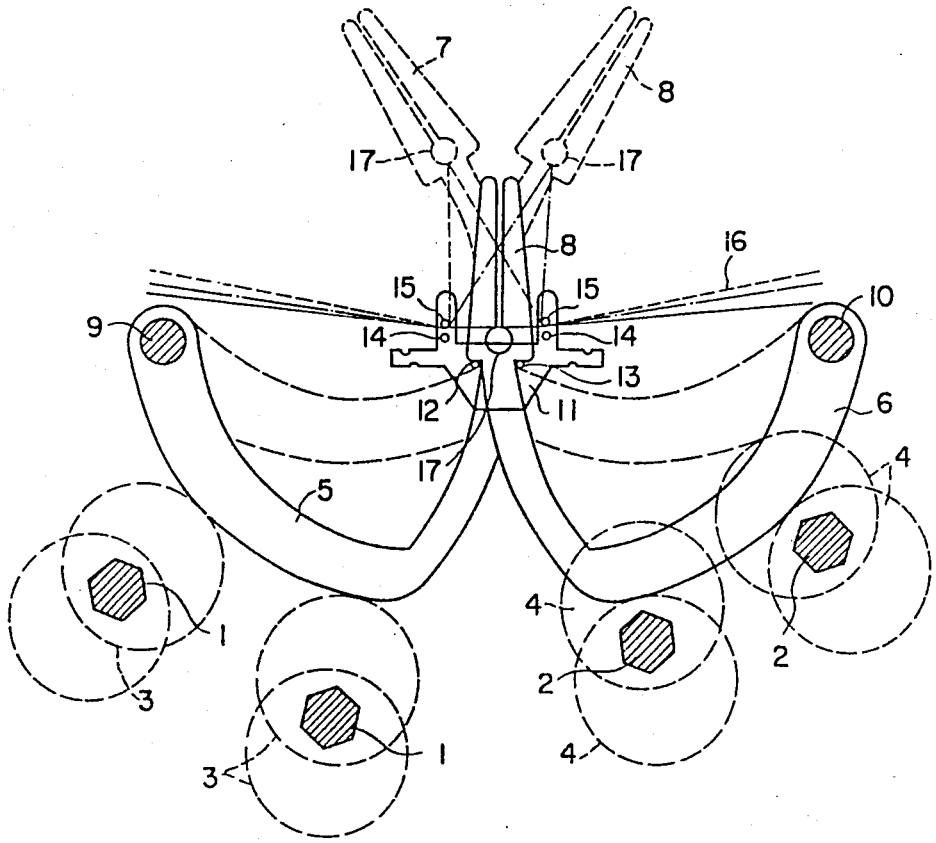
FIG. 1 is a somewhat diagrammatic view in lateral elevation of the general arrangement of the basic elements involved in the production of irregular effects in fabrics.
Figure 2:
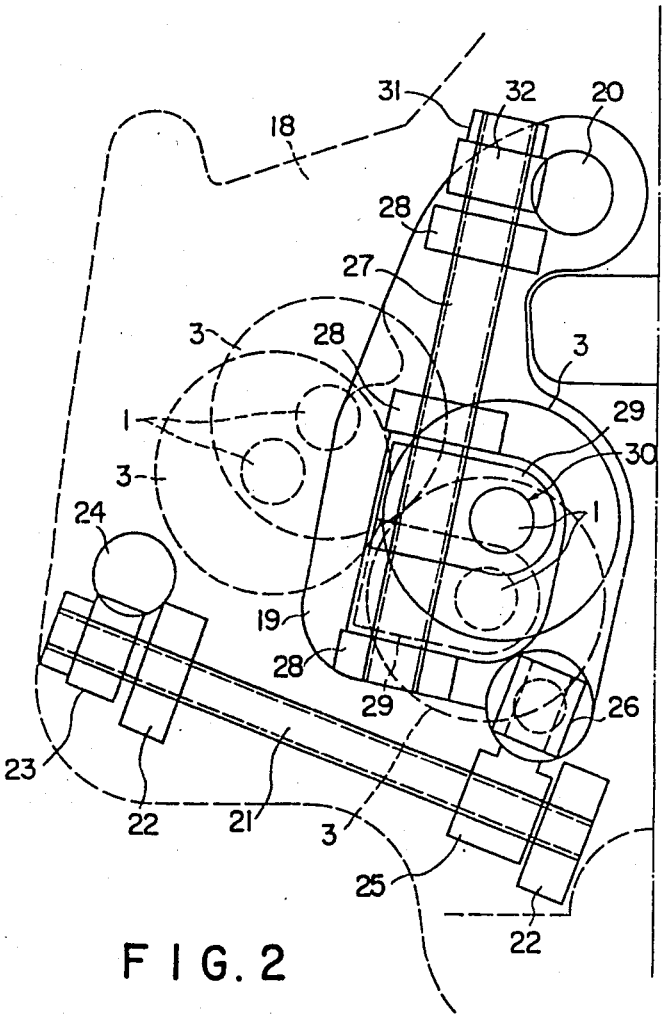
FIG. 2 is another view in lateral elevation showing a device acting on the camshafts to establish the depth of the tension of the yarn and to establish the degree of intermittency of the tensioning of the yarns.

The mechanism intended to product irregular effects, having different appearances, in warp knitting using a conventional machine and yarn is of the type in which at least one camshaft acts in a predetermined manner on the tension and slackening of the warp yarns, the cams of the said camshaft being mounted on a hexagonal shaft and adopting different relative positions which predetermine their operation.

In accordance with the drawings, the mechanism comprises two hexagonal shafts 1 and 2 of two series of cams 3 and 4 which, in addition to possessing a rotary movement, with mutually different velocities to establish the length of the pattern, also possess a controllable translatory movement which establishes the depth of the tension and another movement, also controllable, which establishes the degree of intermittency of the tensioning of the warp yarns of one or more beams.

The cams 3 and 4 act on the curved arms 5 and 6 of two equal forks 7 and 8 which are alternately brought face to face and which oscillate on corresponding shafts 9 and 10 and are guided between pairs of adjacent vertical plates 11 which are equidistant from the said axes, which plates are pierced along two lengthwise sections by two wires 12 and 13 on which the forks 7 and 8 rest when the cams 3 and 4 are not operating. The plates 11 are also pierced by other pairs of lateral lengthwise parallel wires 14 and 15 which form guides for the yarn 16 which pass between the arms of the forks 7 and 8 through a widening 17 at the bottom of the said forks, which facilitates the threading of the yarn, the tension of which is ensured principally by virtue of the widened configuration of the arms of the said forks and their proximity.

When a cam acts upon a fork and raises it, the yarn follows the fork as it rises, and a part of the feed which takes place from the beam is absorbed by the ascending movement of the fork, during which the yarn is sub-fed to the corresponding needle, the columns of stitches in the fabric being brought closer together as a result of the consequent increase in tension, after which, and beginning with the descent of the fork, the latter adds to the quantity of yarn supplied by the beam the yarn which it had stored in the course of its rise, as a result of which the needle is overfed, and a consequent relaxation takes place of the columns of stitches in which the yarn is involved.

On each side piece 18 there is provided a mechanical device which acts on the camshafts, which device comprises a vertical support plate 19 on which is supported a corresponding shaft (such as, for example, the shaft 1 of the cam 3), which support plate 19 is articulated at the top by means of a pin 20 to the side piece 18, the said pin being located in the center of the arc of circumference which is described by the external part of the curved arms 5 and 6 of the fork 7 and 8. The device possesses a spindle 21 mounted on two supports 22 and bears a pinion 23 upon which acts a transverse endless screw 24, which spindle 21 bears a threaded element 25 wedged on the said spindle and articulated via a bearing 26 to the lower part of the support plate 19, in a manner such that by acting on the endless screw 24 an oscillating movement of the said support plate 19 is obtained about the pin 20 and a controlled translatory movement of the cam 3 is achieved, setting the depth (that is, the magnitude) of the tension of the yarn which is selectively controlled by means of a pointer (not shown).

The mechanical device in question comprises, moreover, a spindle 27 which is appropriately rotatably mounted on plate 19 through supports 28 and bears a threaded block 29 supporting a bearing 30 for the shaft 1 of the cam 3. At the top, the said spindle 27 is suspended from the support plate 19 by means of a support 31 and bears a pinion 32 which is actuated by means of an endless screw (which may be a part of the pin 20) provided with a control in order to rotate spindle 27 to produce the controlled ascending and descending displacement of the shaft 1 of the cam 3, and to establish in this manner the degree of intermittency of tensioning of the yarns 16. The said spindle 27 is provided with a pointer which indicates on a graduated scale (not shown) the intermittency figure.

The oscillating movement which establishes the depth of the tension of the yarn and the ascending movement which establishes the intermittency of the tensioning of the yarns are imparted by means of the transverse axes of the endless screws 20 and 24 to all the twin mechanical devices situated along the machine.

An appropriate description having been provided of the object of the improvements to which the invention relates, it is necessary to point out expressly that the operating systems are variable, it being possible for the said systems to be as described or to make use of a connecting rod mechanism, with the axis of the spindle between the cam and the yarn, of different sizes, shapes and materials of the corresponding mechanisms which are capable of modifications which will be protected by the filing of the patent, provided that such modifications do not involve any alteration to the essential nature of the invention as summarized in the accompanying claims.

What I claim is:

1. A mechanism for producing irregular effects having different appearances in warp knitting using a conventional machine and yarn, the machine being of the kind having beams from which are fed warp yarns to needles for making columns of stitches to produce a fabric, the mechanism being of the type including a cam which acts in a predetermined manner on the tension and slackening of the warp yarns and a camshaft on which said cam is mounted and which adopts different relative positions which predetermine its operation, wherein the mechanism particularly comprises:

two said camshafts mounting respective said cams for (1) rotary movement, with mutually different velocities to establish the length of the pattern, (2) a controllable translatory movement which establishes the depth of the tension and (3) a controllable further movement which establishes the degree of intermittency of the tensioning of the warp yarns of one or more of the machine;

two spaced shafts;

two equal forks having respective curved arms and having tines, said forks being mounted for oscillation on respective ones of said two spaced shafts, said cams respectively acting on the curved arms of said two equal forks to raise said forks out of face to face alignment;

pairs of adjacent vertical plates between which said forks are guided, said pairs of adjacent vertical plates being equidistant from said two spaced shafts;

two wires which pierce the adjacent vertical plates and act as supports for each fork when its associated cam is not operating;

pairs of parallel wires which also pierce the adjacent vertical plates and form guides for yarns passeed between the tines of the forks;

such that, (1) when a said cam raises its fork, the yarn follows the ascending fork and part of the yarn feed from the beam is absorbed by the ascending movement of the fork so that the yarn is sub-fed to the corresponding needle and the columns of stitches in the fabric are brought closer together as a result of the consequent increase in yarn tension, and (2) a subsequent descent of the fork adds to the quantity of yarn supplied by the beam the yarn stored by the fork during its ascent, so that the needle is overfed and a consequent relaxation takes place in the columns of stitches in which the yarn is involved.

2. Apparatus according to claim 1 including a side piece and a mechanical device on the side piece for acting on the camshafts, said device comprising:

means for bringing about a controlled translatory movement of the cam to establish the depth of tension of the yarn and therewith to allow selective control of said tension, said means including a vertical support plate on which is supported a corresponding said camshaft, said vertical support plate being articulated at its top on the side piece, a transversely acting screw, a spindle which is actuated by said transversely acting screw, a transversely linked slide and a bearing located on said vertical support plate, said screw imparting its displacement, by means of said transversely linked slide to said bearing on the vertical support plate and thereby bringing about an oscillating movement of the said plate and a controlled translatory movement of the cam; and means for producing a controlled ascending and descending displacement of the camshaft and thus to determine the degree of intermittency of tensioning of the yarns and therewith to allow selective control of the degree of intermittency of said tensioning, said means including a support fixed to the vertical support plate, a further spindle guided at the bottom by said support, a support block movable by said further spindle, and a bearing for the camshaft carried by said support block, the top the said further spindle being supported with respect to said vertical support plate, and a further transversely acting endless screw for actuating the further spindle in order to produce the controlled ascending and descending displacement of the camshaft, the first-mentioned and further endless screws having axes transverse to said vertical support plate, both the oscillating movement which establishes the depth and the ascending and descending movement which establishes the intermittency being imparted by means of the transverse axes of the endless screws to a plurality of said mechanical devices situated along the machine.

3. Apparatus as claimed in claim 1, wherein the tines of the forks are wide and are located very close together, a small widening being provided between the tines at a location level with the bottom of the tines, in order to facilitate the threading, and ensure the retention, of the yarn with respect to the forks.

* * * * *